US007137748B2

(12) United States Patent
Kawaguchi

(10) Patent No.: US 7,137,748 B2
(45) Date of Patent: Nov. 21, 2006

(54) NITRIDE LAYER FORMING METHOD, MAGNETIC CIRCUIT FORMING MEMBER, ARMATURE, WIRE DOT PRINTER HEAD AND WIRE DOT PRINTER

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 205 days.

(21) Appl. No.: 10/940,432

(22) Filed: Sep. 14, 2004

(65) Prior Publication Data

US 2005/0207814 A1 Sep. 22, 2005

(30) Foreign Application Priority Data

Mar. 22, 2004 (JP) ..... 2004-082320

(51) Int. Cl.
*B41J 2/27* (2006.01)

(52) U.S. Cl. ..... 400/124.01; 400/124.11

(58) Field of Classification Search .....
400/124.01–124.23, 157.1, 157.2; 101/93.05, 101/93.29

See application file for complete search history.

(56) References Cited

U.S. PATENT DOCUMENTS

| | | | |
|---|---|---|---|
| 3,804,224 | A | 4/1974 | Barnaby et al. |
| 4,552,064 | A | 11/1985 | Sanders, Jr. et al. |
| 4,674,896 | A | 6/1987 | Yasunaga et al. |
| 4,697,939 | A | 10/1987 | Ara |
| 4,767,227 | A | 8/1988 | Mitsuishi et al. |
| 4,881,832 | A | 11/1989 | Mitsuishi et al. |
| 4,988,223 | A | 1/1991 | Hilkenmeier et al. |
| 4,993,854 | A | 2/1991 | Sato |
| 5,074,687 | A | 12/1991 | Gugel |
| 5,137,377 | A | 8/1992 | Ito et al. |
| 5,205,659 | A | 4/1993 | Gugel et al. |
| 5,290,112 | A | 3/1994 | Stempfle et al. |
| 5,674,014 | A | 10/1997 | Jordan |
| 6,513,997 | B1 | 2/2003 | Terao |
| 6,682,233 | B1 | 1/2004 | Terao et al. |
| 6,698,956 | B1 | 3/2004 | Terao et al. |
| 6,776,545 | B1 | 8/2004 | Terao |
| 6,805,503 | B1 | 10/2004 | Tsuchiya et al. |
| 6,848,843 | B1 | 2/2005 | Kawaguchi |
| 2004/0170461 | A1 | 9/2004 | Kawaguchi |
| 2005/0201797 | A1 | 9/2005 | Kawaguchi |
| 2005/0201798 | A1 | 9/2005 | Kawaguchi et al. |

(Continued)

FOREIGN PATENT DOCUMENTS

| | | | |
|---|---|---|---|
| JP | 02-011336 | A | 1/1990 |

(Continued)

OTHER PUBLICATIONS

U.S. Appl. No. 10/655,281, Inventor: Kawaguchi, T., filed Sep. 3, 2003.

(Continued)

*Primary Examiner*—Minh Chau
(74) *Attorney, Agent, or Firm*—Frishauf, Holtz, Goodman & Chick, P.C.

(57) ABSTRACT

In order to realize stable rocking operation of the armature and further obtain magnetic characteristics required for high-speed printing, the magnetic circuit forming member formed of magnetic material like a plate and having the through hole in the direction of thickness thereof is stacked in two or more layers in the direction of thickness, pressure is applied to the two or more stacked magnetic circuit forming members in the stacking direction to make the magnetic circuit forming members adhere to each other, and the two or more magnetic circuit forming members put in the adhering state are subjected to nitriding.

11 Claims, 8 Drawing Sheets

U.S. PATENT DOCUMENTS

2005/0201799 A1 9/2005 Tsuchiya et al.

FOREIGN PATENT DOCUMENTS

| | | | |
|---|---|---|---|
| JP | 7-22994 | B2 | 2/1990 |
| JP | 3-007351 | A | 1/1991 |
| JP | 3-39256 | A | 2/1991 |
| JP | 03-191036 | A | 8/1991 |
| JP | 4-002639 | A | 1/1992 |
| JP | 4-31061 | A | 2/1992 |
| JP | 04-105945 | A | 4/1992 |
| JP | 5-35288 | U | 5/1993 |
| JP | 6-218954 | A | 8/1994 |
| JP | 6-227000 | A | 8/1994 |
| JP | 07-125265 | A | 5/1995 |
| JP | 09-187972 | A | 7/1997 |
| JP | 09-314868 | A | 12/1997 |
| JP | 10-006537 | | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 3-288660 | A | 2/2001 |
| JP | 2001-219586 | A | 8/2001 |

OTHER PUBLICATIONS

U.S. Appl. No. 10/655,894, Inventor: Kawaguchi, T., filed Sep. 4, 2004.

U.S. Appl. No. 10/764,642, Inventor: Kawaguchi, T., filed Jun. 26, 2004.

U.S. Appl. No. 10/940,362, Inventor: Kawaguchi, T. et al., filed Sep. 14, 2004.

U.S. Appl. No. 10/940,361, Inventor: Kawaguchi, K. et al., filed Sep. 14, 2004.

U.S. Appl. No. 10/940,338, Inventor: Kawaguchi, T. et al., filed Sep. 14, 2004.

U.S. Appl. No. 10/940,492, Inventor: Tsuchiya, K. et al., filed Sep. 14, 2004.

U.S. Appl. No. 11/073,118, Inventor: Kawaguchi et al., filed Mar. 3, 2005.

U.S. Appl. No. 11/073,117, Inventor: Tsuchiya et al., filed Mar. 3, 2005.

U.S. Appl. No. 11/073,092, Inventor: Kawaguchi et al., filed Mar. 3, 2005.

U.S. Appl. No. 11/073,093, Inventor: Kawaguchi et al., filed Mar. 3, 2005.

Related U.S. Appl. No. 11/248,639, filed Oct. 7, 2005; Inventor: T. Kawaguchi.

Related U.S. Appl. No. 11/301,412, filed Dec. 13, 2005; Inventor: T. Kawaguchi.

NITRIDE LAYER FORMING METHOD, MAGNETIC CIRCUIT FORMING MEMBER, ARMATURE, WIRE DOT PRINTER HEAD AND WIRE DOT PRINTER

CROSS REFERENCE TO RELATED APPLICATION

The present application is based on Japanese Priority Document 2004-82320 filed on Mar. 22, 2004, the content of which is incorporated herein by reference.

BACKGROUND OF THE INVENTION

1. Field of the Invention

This invention relates to a nitride layer forming method, a magnetic circuit forming member, an armature, a wire dot printer head and a wire dot printer.

2. Discussion of the Background

The wire head printer head is adapted to rock an armature to which a printing wire is connected between a print position and a standby position and impact the tip of the wire in a print medium when the armature is rocked to the print position to perform printing. As the wire dot printer head, a device has been proposed, in which magnetic flux is generated in the periphery of the armature as a rocking object by a coil, and a magnetic circuit for attracting the armature from the standby position to the print position is generated to perform printing (See JP-A-2000-280497). In the invention described in JP-A-2000-280497, in order to heighten the strength of the armature, a nitride layer is formed on the surface of the armature.

On the other hand, the armature is provided with a fulcrum shaft functioning as the center of rotation and a through hole for inserting the fulcrum shaft, and disposed to be freely rotated (rocked) by holding the fulcrum shaft. In this case, the fulcrum shaft is rotatably inserted in the through hole. Consequently, during the printing operation, the fulcrum shaft is slid along the through hole, so that the inner surface of the through hole wears away. In order to prevent such abrasion, generally a nitride layer is formed on the surface (including the inner surface of the through hole) of the armature to improve the strength of the armature.

In the armature having the nitride layer formed on the whole surface thereof, however, the magnetic flux characteristic is deteriorated by the nitride layer. In recent years, it is necessary to increase the printing speed, that is, rock the armature between the print position and the standby position at a high frequency as much as 2500 times/sec. In that case, the armature having the nitride layer formed on the whole surface has the problem that the magnetic characteristic required for high-speed printing can not be obtained, so high-speed printing can not be performed.

Further, in the case where the fulcrum shaft is provided in the through hole as in the above armature, it is necessary to form a nitride layer or the like on the inner surface of the through hole. In the case where a nitride layer is not formed on the inner surface of the through hole, the fulcrum shaft slides along the through hole during the printing operation, so that the inner surface of the through hole wears away to cause jogging of the fulcrum shaft, resulting in the problem that the rocking operation of the armature becomes unstable.

SUMMARY OF THE INVENTION

The present invention has been made in view of the above circumstances to realize the stable rocking operation of an armature and further obtain the magnetic characteristics required for high-speed printing.

According to a nitride layer forming method of the invention, a magnetic circuit forming member formed like a plate by magnetic material and having a through hole penetrating in the direction of thickness is stacked in two or more layers in the direction of thickness, pressure is applied to the two or more stacked magnetic circuit forming members in the stacking direction, the two or more stacked magnetic circuit forming members are made to adhere to each other, and nitriding is performed for the two or more magnetic circuit forming members put in the adhering state to form a nitride layer on the magnetic circuit forming members.

According to another nitride layer forming method of the invention, a magnetic circuit forming member formed like a plate by magnetic material and having a through hole penetrating in the direction of thickness is held between holding members in the direction of thickness not to cover the through hole, pressure is applied to the magnetic circuit forming member held by the holding members in the direction of thickness to make the holding members and the magnetic circuit forming member adhere to each other, and nitriding is performed for the magnetic circuit forming member adhering to the holding members to form a nitride layer on the magnetic circuit forming member.

According to another nitride layer forming method of the invention, a plate-like plate member formed of magnetic material is stacked in two or more layers, a through hole is formed in the two or more stacked plate members in the stacking direction, pressure is applied to the two or more stacked plate members having the through hole in the stacking directions, the two or more stacked plate members are made to adhere to each other, nitriding is performed for the two or more plate members put in the adhering state, and a magnetic circuit forming member having a through hole is formed from the two or more nitrided plate members to form a nitride layer on the magnetic circuit forming member.

A magnetic circuit forming member of the invention is formed of magnetic material like a plate and provided with a through hole penetrating in the direction of thickness, and with a nitride layer on the surface thereof outside of both end faces in the penetrating direction of the through hole.

Another magnetic circuit forming member of the invention is formed of magnetic material like a plate and provided with a through hole penetrating in the direction of thickness, and with a nitride layer only on the inner surface of the through hole.

An armature of the invention includes an arm supporting a printing wire and a magnetic circuit forming member provided on the arm, and the magnetic circuit forming member is formed of magnetic material like a plate and provided with a through hole penetrating in the direction of thickness, and with a nitride layer on the surface thereof outside of both end faces in the penetrating direction of the through hole.

An armature of the invention includes an arm supporting a printing wire and a magnetic circuit forming member provided on the arm, and the magnetic circuit forming member is formed of magnetic material like a plate and provided with a through hole penetrating in the direction of thickness, and with a nitride layer only on the inner surface of the through hole.

A wire dot printer head of the invention includes one of the above armatures, a printing wire provided on the armature, a support member supporting the armature to be freely rocked in the direction substantially parallel to the printing wire, and a core where a coil is wound, which is provided in a position opposite to the magnetic circuit forming member of the armature in the rocking direction of the armature.

A wire dot printer of the invention includes the wire dot printer head, a platen opposite to the wire dot printer head, a carriage adapted to hold the wire dot printer head and reciprocate along the platen, and a print medium transport part for transporting a print medium between the wire dot printer head and the platen, and the drive of the wire dot printer head, the carriage and the print medium transport part is controlled to perform printing on the basis of print data.

BRIEF DESCRIPTION OF THE DRAWINGS

A more complete appreciation of the present invention and may of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

One preferred mode for carrying out the invention will now be described with reference to FIGS. 1 to 8.

<Wire Dot Printer Head>

Figure 1:
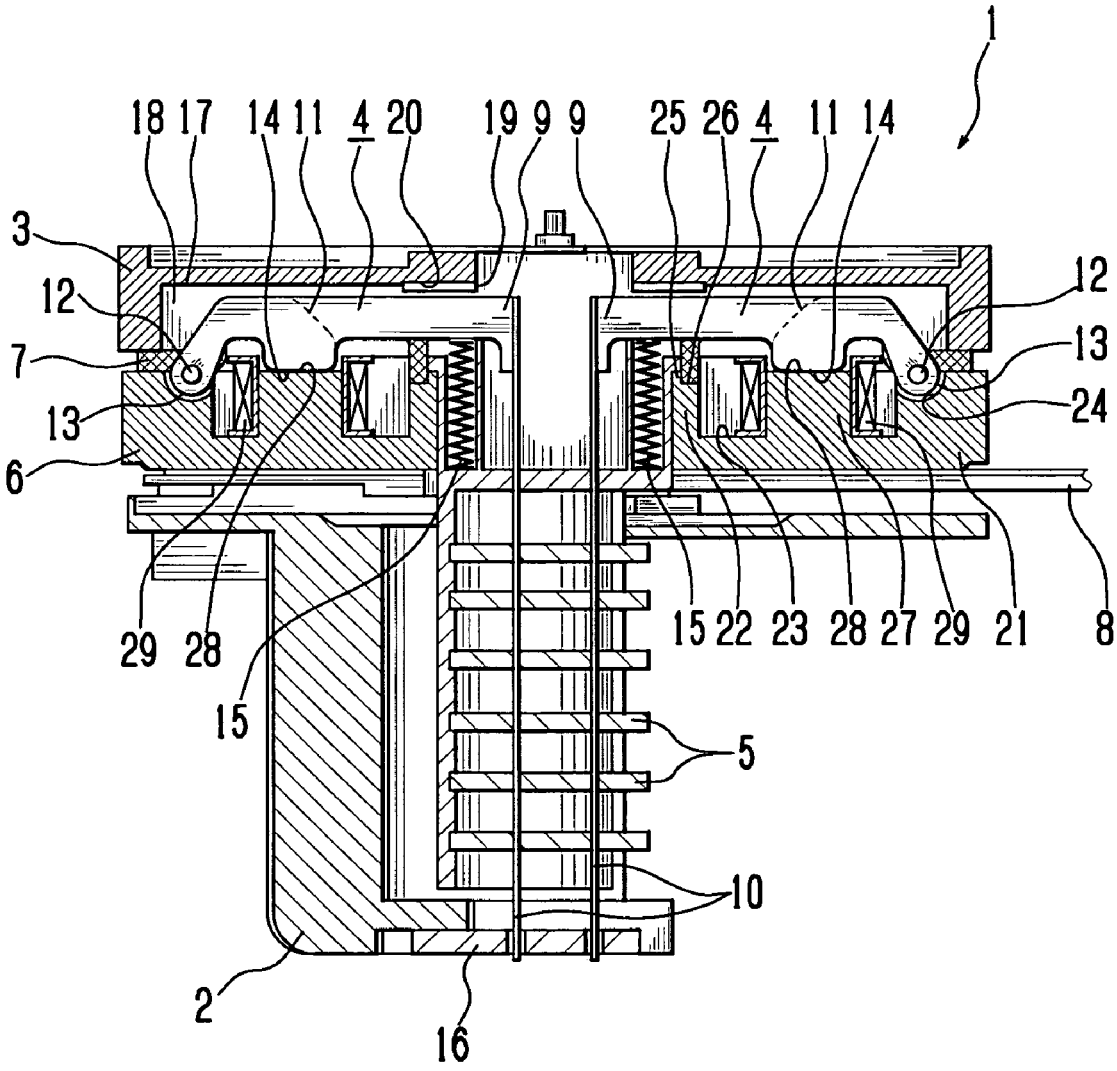
FIG. 1 is a schematic front view of the central longitudinal section showing one embodiment of a wire dot printer head according to the invention.
Figure 2:
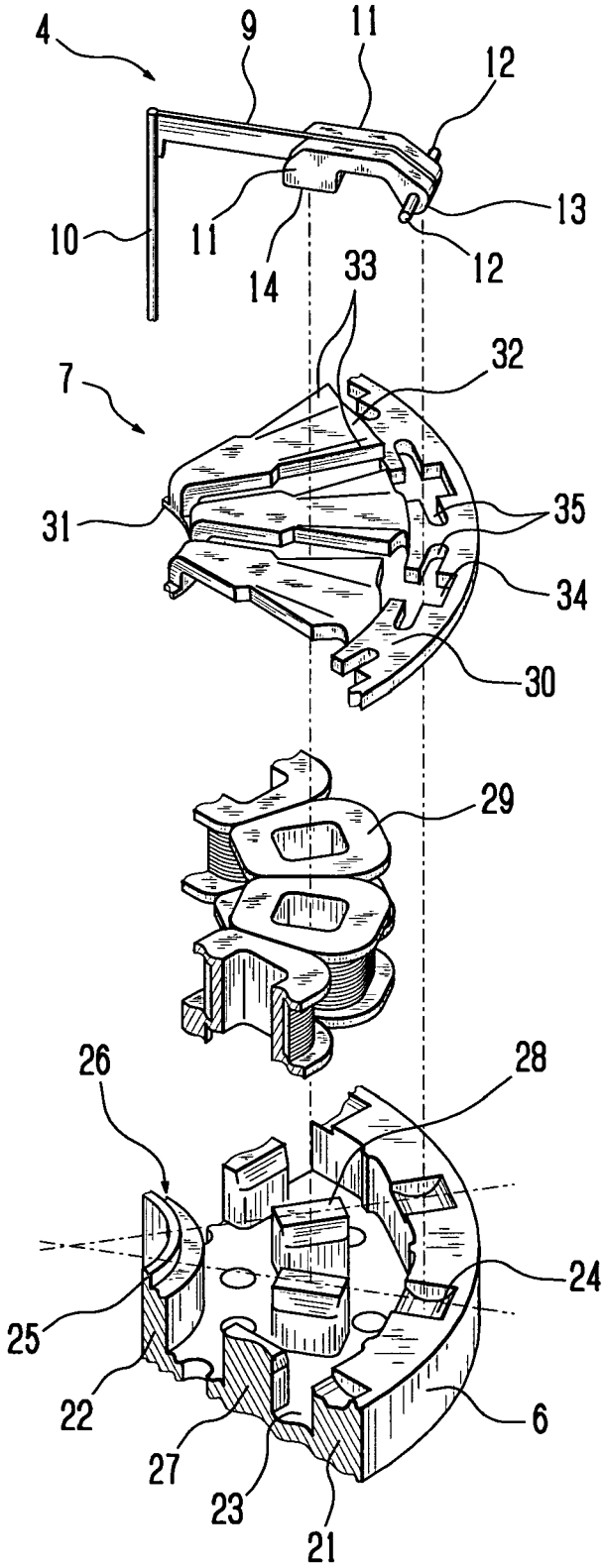
FIG. 2 is a schematic exploded perspective view partly showing one embodiment of a wire dot printer head according to the invention.

First the general configuration of a wire dot printer head 1 will now be described with reference to FIGS. 1 to 3. FIG. 1 is a schematic central longitudinal front view of a wire dot printer head 1, FIG. 2 is a partial schematic exploded perspective view of the wire dot printer head 1, and FIG. 3 is a schematic exploded perspective view of an armature 4 of the wire dot printer head 1.

The wire dot printer head 1 is provided with a front case 2 and a rear case 3 connected to each other by a fitting screw (not shown). An armature 4, a wire guide 5, a yoke 6, an armature spacer 7 and a circuit board 8 are disposed between them.

The armature 4 includes an arm 9 formed like a plate and supporting a print wire 10 for printing (hereinafter referred to as wire simply) at one end in the longitudinal direction (extending direction of the arm 9), a magnetic circuit forming member 11 provided on both sides surfaces of the arm 9 in the cross direction (in the direction of thickness) for forming a magnetic circuit and a fulcrum shaft 12 functioning as the center of rotation (center of rocking). The wire 10 is brazed to one end of the arm 9. A circular-arc part 13 is formed on the end of the armature 4 on the other end side thereof.

Figure 3:
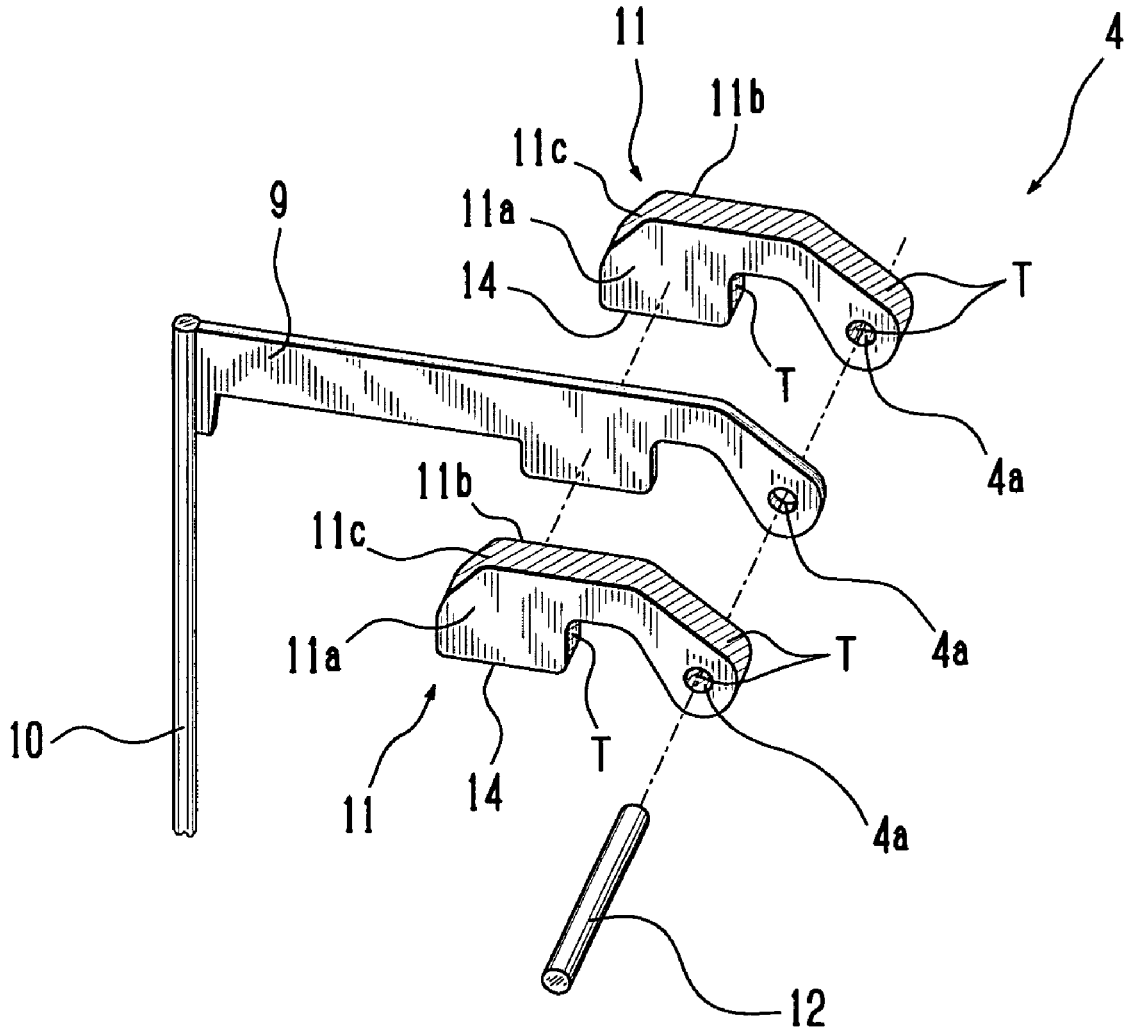
FIG. 3 is a schematic exploded perspective view showing an armature of one embodiment of a wire dot printer head according to the invention.

The fulcrum shaft 12 is inserted in a through hole 4*a* formed in the armature 4 (See FIG. 3). The through hole 4*a* is formed to penetrate the arm 9 and the magnetic circuit forming member 11 in the direction of thickness thereof. The fulcrum shaft 12 is provided in the through hole 4*a* to freely rotate. This type of fulcrum shaft 12 is formed of a piano wire (SWP-B: Hv 700 or higher) subjected to surface hardening.

The magnetic circuit forming member 11 is formed like a plate by magnetic material. The magnetic circuit forming member 11 is provided with an attracted surface 14, and the attracted surface 14 is positioned in the central part in the longitudinal direction of the armature 4. Further the surface of the magnetic circuit forming member 11 is subjected to nitriding as surface hardening. Thus, the magnetic circuit forming member 11 is provided with a nitride layer T on the surface outside of both side surfaces 11*a*, 11*b* which are both end faces in the direction of thickness (the cross direction of the arm 9) (See FIG. 3). That is, the nitride layer T is formed on the inner surface of the through hole 4*a* as well. Although the nitride layer T is formed on the surface 11*a* parallel to the direction of thickness of the magnetic circuit forming member 11 and the inner surface of the through hole 4*a* in this case, this is not restrictive. It is, however, necessary that the nitride layer T is formed on the inner surface of the through hole 4*a* to prevent abrasion of the inner surface of the through hole 4*a* due to the fulcrum shaft 12. Two or more armatures 4 of this type are disposed radially in relation to the axis of a yoke 6. The armatures 4 are respectively supported on the surface of the yoke 6 in the state of freely rotating (freely rocking) around the fulcrum shaft 12 in the direction of separating form the yoke 6, and energized in the direction of separating from the yoke 6 by an energizing member 15 such as a coiled spring. The energizing member 15 is provided to perform the energizing operation.

The wire guide 5 is adapted to guide the wire 10 to freely slide so that the tip of the wire 10 impacts on a designated position of a print medium. The front case 2 is provided with a tip guide 16 for aligning the tip part of the wire 10 in a designated pattern and guiding the wire 10 to freely slide. When the armature 4 rocks to the print position, with the rocking operation of the armature 4, the tip part of the wire 10 is moved to a designated position, for example, the position of colliding with the print medium such as paper.

The rear case 3 is provided with a cylindrical part 18 having a base part 17 at one end. A mounting recessed part 20 for mounting a metal-made annular armature stopper 19 is formed in the central area of the base part 17. The armature stopper 19 is mounted in the mounting recessed part 20 by fitting. In this case, when the armature 4 is rocked from the print position by the energizing member 15, the arm 9 which is a part of the armature abuts on the armature stopper 19 to stop the rocking of the armature 4. Thus, the armature stopper 19 has a function of fixing the standby position of the armature 4.

The circuit board 8 includes a driving circuit for controlling the rocking of the armature between the print position and the standby position. The driving circuit of the circuit board 8 selectively rocks an arbitrary armature 4 of two or more armatures 4 in print operation.

The yoke 6 is formed of magnetic material and provided with a pair of cylindrical parts 21, 22 formed concentrically and different in diameter. The dimensions in the axial direction (in the vertical direction of the paper surface in FIG. 1, that is, in the axial direction of the yoke 6) of the respective cylindrical parts 21, 22 are set equal to each other. The outer peripheral cylindrical part 21 and the inner peripheral cylindrical part 22 are integrated with each other by a base part 23 provided to block up one end side in the axial direction. The thus formed yoke 6 is held with the open side on the opposite side to the base part 23 opposite to the open side of the rear case 3 between the front case 2 and the rear case 3.

The outer peripheral cylindrical part 21 is provided with two or more recesses 24 of the same number as that of the armatures 4. In these recesses 24, the inner peripheral surface thereof has a concave shape formed with the substantially same radius of curvature as the radius of curvature of the outer peripheral surface of the circular-arc part 13 of the armature 4. The circular-arc part 13 formed on one end side of the armature 4 is slidably fitted in the recess 24.

The inner peripheral cylindrical part 22 is provided with an annular engaged part 25. The engaged part 25 is integrated with the inner peripheral cylindrical part 22 to be positioned concentrically with the inner peripheral cylindrical part 22. The outside diameter of the engaged part 25 is set smaller than that of the inner peripheral cylindrical part 22. Accordingly, the inner peripheral cylindrical part 22 is provided with a step part 26 formed by the engaged part 25.

The base part 23 is integrally provided with two or more cores 27 positioned to be annular between the outer peripheral cylindrical part 21 and the inner peripheral cylindrical part 22. The dimensions of the respective cores 27 in the axial direction of the yoke 6 are set equal to the dimensions of the cylindrical parts 21, 22 in the axial direction of the yoke 6.

In each core 27, a magnetic pole surface 28 is formed at one end in the axial direction of the yoke 6. The magnetic pole surface 28 of the core 27 is disposed opposite to the attracted surface 14 of the magnetic circuit forming member 11 provided on the armature 4. A coil 29 is mounted on the outer periphery of each core 27. That is, the yoke 6 is provided with two or more cores 27 positioned to be annular, on which the coils 29 are respectively wound. Although the winding direction is set equal in all of the coils 29 in the present embodiment, this is not restrictive, but the coils different in winding direction may be selectively disposed.

An armature spacer 7 includes a pair of ring-shaped parts 30, 31 having the substantially same diameter as those of the cylindrical parts 21, 22 of the yoke 6, and two or more guide parts 32 radially stretched between the paired ring-shaped parts 30, 31 to be positioned between the armatures 4. The guide parts 32 serve as side magnetic paths to the armatures 4. The outer peripheral ring-shaped part 30 and the inner peripheral ring-shaped part 31 are provided concentrically. The outer peripheral ring-shaped part 30, the inner peripheral ring-shaped part 31 and the guide parts 32 are formed integral with each other.

When the armature spacer 7 is mounted on the yoke 6, the outer peripheral ring-shaped part 30 and the inner peripheral ring-shaped part 31 respectively abut on the cylindrical parts 21, 22 of the yoke 6, and the inner peripheral ring-shaped part 31 is engaged with the engaged part 25. The inside diameter of the inner peripheral ring-shaped part 31 is set equal to or a little larger than that of the engaged part 25.

Each guide part 32 is provided with side yoke parts 33 extended along the substantially radial directions of the ring-shaped parts 30, 31 obliquely in the direction of separating from the magnetic pole surface 28 of the core 27. The side yoke part 33 is shaped like a blade gradually increased in width as it goes from the inner peripheral ring-shaped part 31 toward the outer peripheral ring-shaped part 30.

In the armature spacer 7, two or more guide parts 32 are stretched between the paired ring-shaped parts 30, 31, whereby slit-like guide grooves 34 opened along the radial directions of the ring-shaped parts 30, 31 are secured. The respective guide grooves 34 are formed to have such a width that the side yoke parts 33 of each guide part 32 approach the magnetic circuit forming members 11 not to obstruct rocking of the armature 4.

The guide groove 34 is communicated with the outer peripheral ring-shaped part 30, and the guide groove 34 in the outer peripheral ring-shaped part 30 is provided with raceways 35 formed as cutout parts connected and opened to the guide groove 34 along the direction of the outside diameter of the ring-shaped part 30 on both sides of the guide grove 34. The fulcrum shafts 12 of the armature 4 are fitted in the raceways 35. That is, the fulcrum shafts 12 of the armature 4 are held by the yoke 6 and the armature spacer 7 so that the armature 4 is opposite to the core 27.

The armature spacer 7 is provided with two or more pressing members (not shown) formed thereon for pressing the fulcrum shafts 12 of the two or more armatures 4 fitted in the raceways 33. The pressing members are plate-like members adapted to press the fulcrum shafts 12 of the two or more armatures 4 by connecting the front case 2 and the rear case 3 by a fitting screw. The pressing members are formed annular not to obstruct the rocking of the armature 4.

<Wire Dot Printer>

Figure 4:
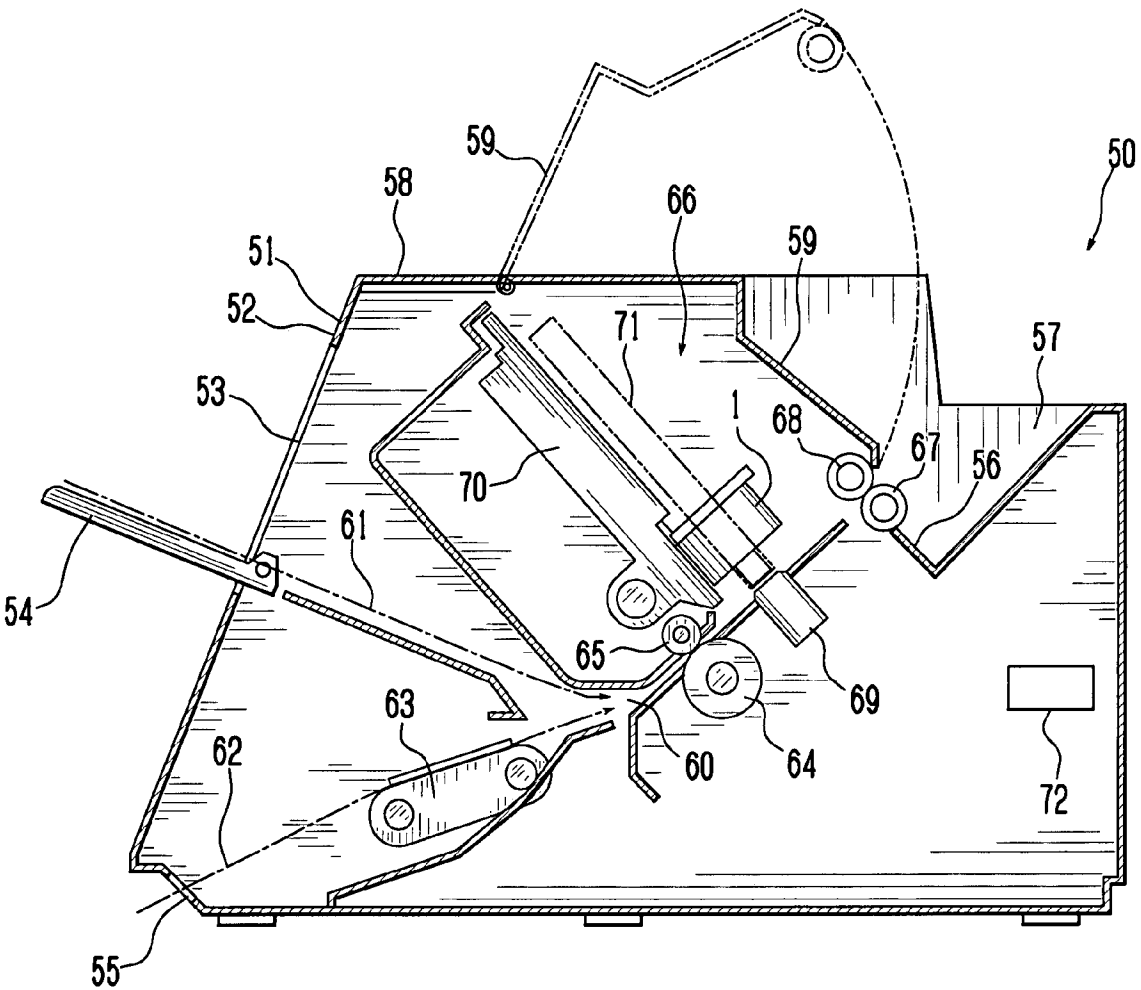
FIG. 4 is a schematic longitudinal side view of one embodiment of a wire dot printer according to the invention.

A wire dot printer 50 including the above wire dot printer head 1 will now be described with reference to FIG. 4. FIG. 4 is a schematic longitudinal side view showing one embodiment of a wire dot printer 50 according to the invention.

The wire dot printer 50 includes a body case 51. An opening part 53 is formed in the front 52 of the body case 51. The opening part 53 is provided with a manual feed tray 54 to be freely opened and closed. A paper feed port 55 is formed on the lower part of the front 52 side of the body case 51, and a discharged paper catch tray 57 is provided on the back 56 thereof. Further, an opening and closing cover 59 is rotatably provided on the top surface 58 of the body case 51. The opening and closing cover 59 put in the open state in this case is shown in a virtual line in FIG. 4.

A paper transport path 60 as a print medium transport path is provided in the body case 51. The upstream side in the paper transport direction of the paper transport path 60 is connected to a paper feed path 61 disposed on an extended surface of the manual feed tray 54 put in the open state and a paper feed path 62 communicated with the paper feed port 55, and the downstream side in the paper transport direction is connected to the discharged paper catch tray 57. The paper feed path 62 is provided with a tractor 63 for transporting paper.

A transport roller 64 and a pressure roller 65 are disposed opposite to each other in the paper transport path 60, and the pressure roller 65 is brought into pressure contact with the transport roller 64. The transport roller 64 and the pressure roller 65 constitute a paper transport part as a print medium transport part adapted to transport paper as a print medium. Further, the paper transport path 60 is provided with a printer part 66 for performing printing operation for the transported paper, and a paper discharge roller 67 is provided on an inlet of the discharged paper catch tray 57. The pressure roller 63 pressed to the paper discharge roller 67 is rotatably supported on the free end side of the opening and closing cover 59.

The printer part 66 is composed of a platen 69 disposed in the paper transport path 60, a carriage 70 adapted to freely reciprocate in the direction intersecting perpendicularly to the paper transport path 60 along the platen, the above wire dot printer head 1 mounted on the carriage 70, an ink ribbon cassette 71 and so on. The ink ribbon cassette 71 is removably provided.

The carriage 70 is driven by a motor (not shown) to reciprocate along the platen 69. The wire dot printer head 1 is moved to reciprocate in the main scan direction as the carriage 70 reciprocates along the platen 69. Thus, in the present embodiment, the head driving mechanism is realized by the carriage 70, the motor and the like. The wire dot printer 50 incorporates a built-in drive control part 72 for controlling the respective parts in the body case 51, and the drive control part 72 controls the drive of the respective parts such as the printer part 66, the tractor 63 and the motor.

In the above configuration, in the case of using the cutform as paper, a paper sheet is fed from the manual paper feed tray 54, and in the case of using the continuous form as paper, paper is fed from the paper feed port 55. In either case, the paper (not shown) is transported by the transport roller 64, printed by the wire dot printer head 1 and discharged to the discharged paper catch tray 57 by the paper discharge roller 67.

Printing is performed by selectively exciting the coil 29 in the wire dot printer head 1 to thereby attract the armature 4 to the magnetic pole surface 28 of the core 27 to rotate around the fulcrum shaft 12 so that the wire 10 is pressed to the paper on the platen 69 through the ink ribbon (not shown). When the application of an electric current to the coil 29 is shut off, the armature 4 is returned by energizing force of the energizing member 15 and stopped in the standby position by the armature stopper 19. Although the paper is used as a print medium in here, this is not restrictive. For example, it is also possible to use pressure sensitive coloring paper in which pressure is applied to color a pressurized part. In the case of using the pressure sensitive coloring paper as the print medium, printing is performed by coloring of the part pressurized by the pressure of the wire 10 of the wire dot printer head 1.

In the printing operation of the wire dot printer 50, according to the print data, an electric current is selectively applied to the coil 29 under the control of the drive control part 72. Whereupon, a magnetic circuit is formed extending from the core 27 where the selected coil 29 is mounted through the magnetic circuit forming member 11 of the armature 4 disposed opposite to the core 27, a pair of side yoke parts 33 opposite to the magnetic circuit forming member 11, the guide part 32, the outer peripheral cylindrical part 21 and inner peripheral cylindrical part 22 of the yoke 6 and the base part 23 again to the core 27.

The formation of the magnetic circuit generates the attraction for attracting the magnetic circuit forming member 11 to the magnetic pole surface 28 of the core 27 between the attracted surface 14 of the magnetic circuit forming member 11 and the magnetic pole surface 28 of the core 27. By this attraction, the armature 4 is rocked around the fulcrum shaft 12 in the direction of attracting the attracted surface 14 of the magnetic circuit forming member 11 to the magnetic pole surface 28 of the core 27. In the present embodiment, the position where the attracted surface 14 of the magnetic circuit forming member 11 of the armature 4 abuts on the magnetic pole surface 28 of the core 27 is taken as the print position.

The armature 4 is rocked to the print position, thereby projecting the tip part of the wire 10 toward the paper. At the time, the ink ribbon is interposed between the wire dot printer head 1 and the paper, so that the pressure of the wire 10 is transmitted through the ink ribbon to the paper to transfer the ink of the ink ribbon to the paper. Thus, printing is performed.

When the application of an electric current to the coil 29 is shut off, the generated magnetic flux disappears so that the magnetic circuit also disappears. Thus, the attraction of attracting the magnetic circuit forming member 11 to the magnetic pole surface 28 of the core 27 disappears. The armature 4 is energized in the direction of separating from the yoke 6 by the energizing force of the energizing member to rock around the fulcrum shaft 12 toward the standby position. That is, the armature 4 rocks toward the standby position, and the arm 9 thereof abuts on the armature stopper 19 to be stopped in the standby position. This printing operation is performed at high speed (e.g. 2500 times/sec). At the time, the armature 4 rocks at high speed as much as 2500 times/sec between the print position and the standby position.

This high-speed printing is realized because the magnetic circuit forming member 11 has a nitride layer T on the surface thereof outside of both side surfaces 11*a*, 11*b*. That is, since the nitride layer T is formed on the inner surface of the through hole 4*a*, the inner surface of the through hole 4*a* is prevented from abrasion due to the fulcrum shaft 12. Furthermore, since the nitride layer T is not formed on the whole surface of the magnetic circuit forming member 11, lowering of magnetic flux characteristic can be restrained. Thus, the stable rocking operation of the armature 3 is realized to obtain magnetic characteristic required for further high-speed printing. As a result, high-speed printing is realized.

<Nitride Layer Forming Method>

Figure 5:
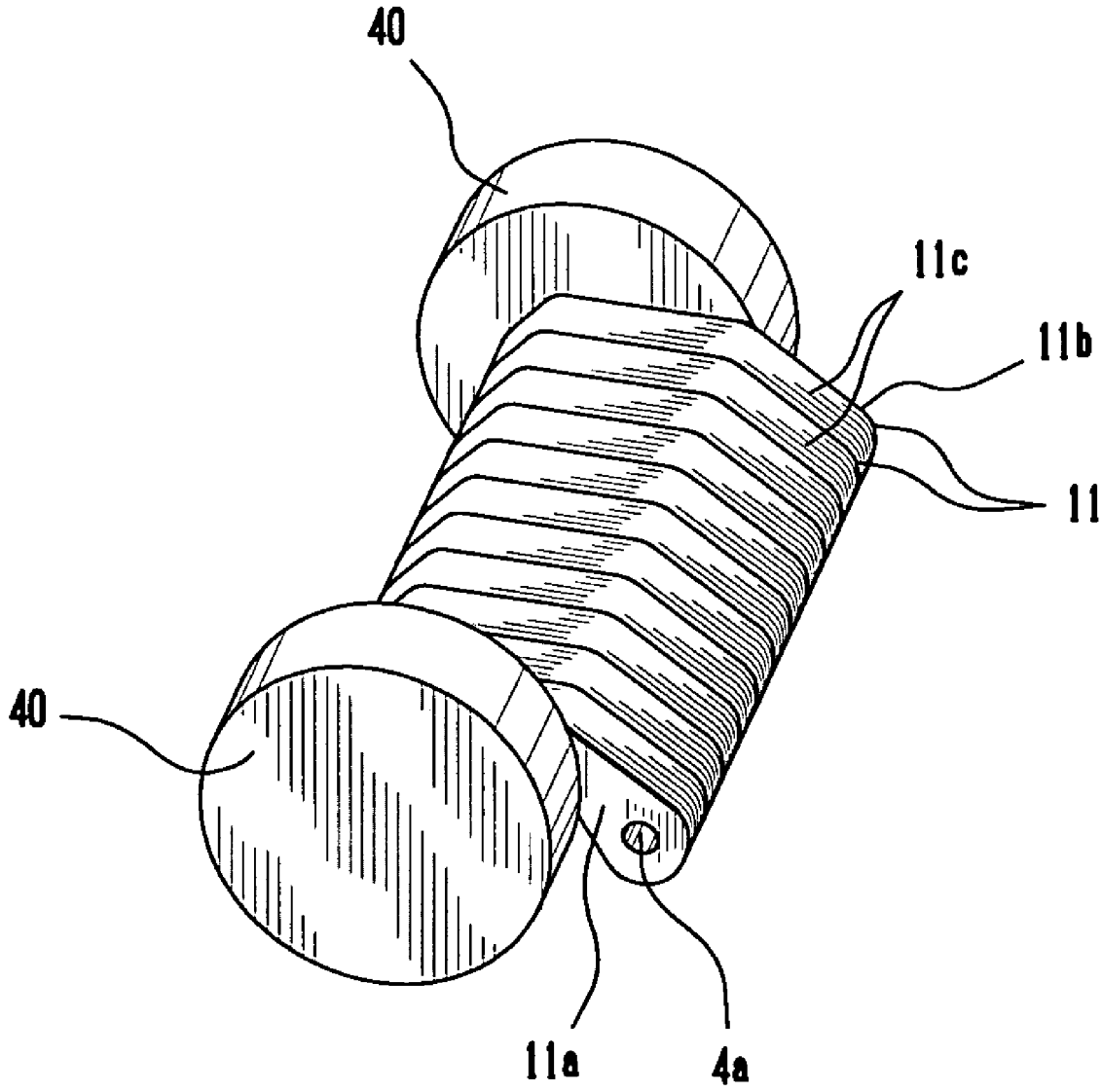
FIG. 5 illustrates a first nitride layer forming process.
Figure 6:
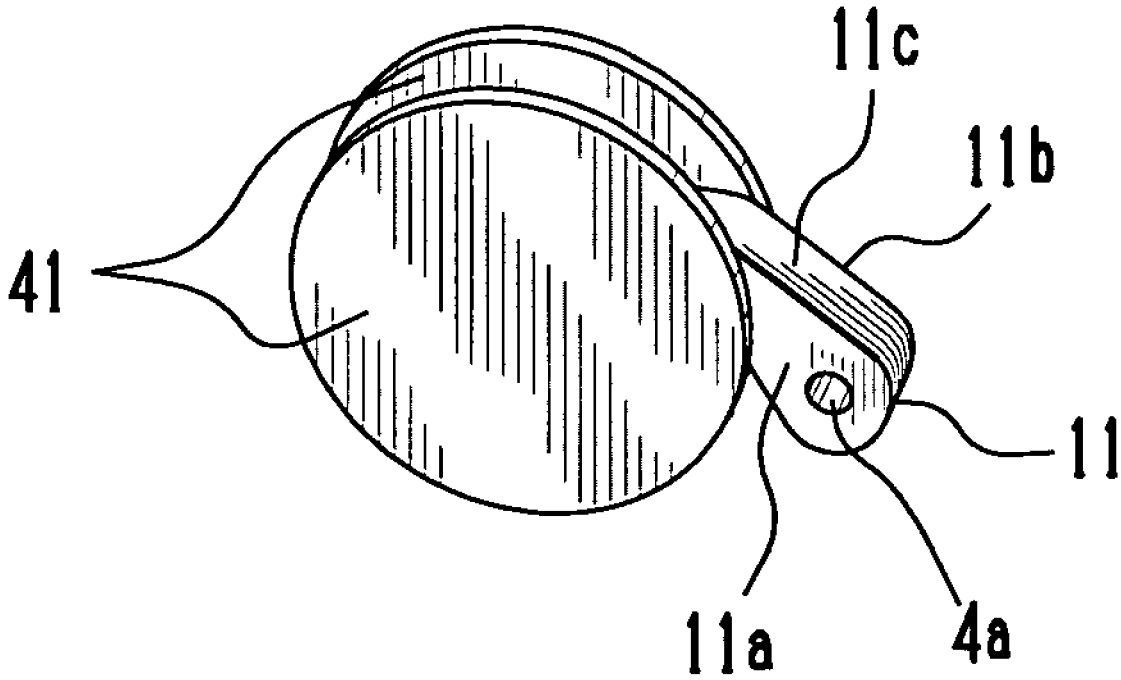
FIG. 6 illustrates a second nitride layer forming process.
Figure 7:
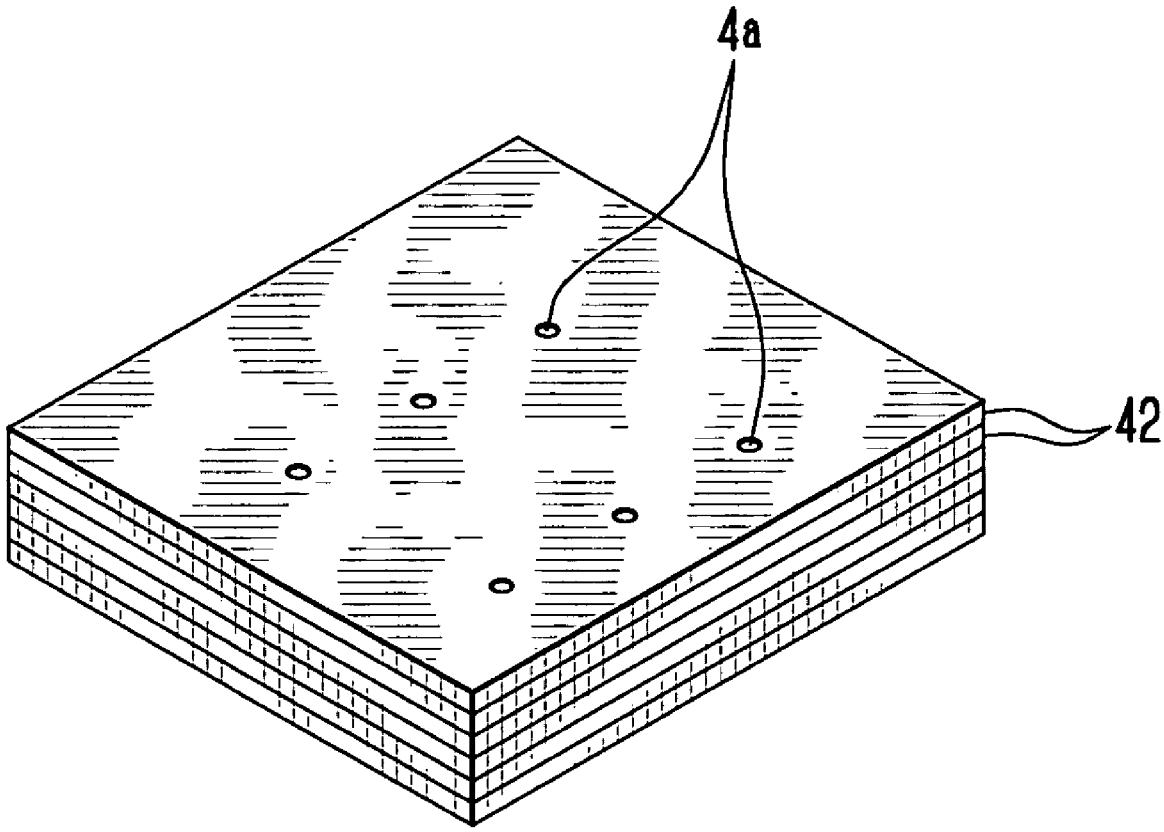
FIG. 7 illustrates a part of a third nitride layer forming process.
Figure 8:
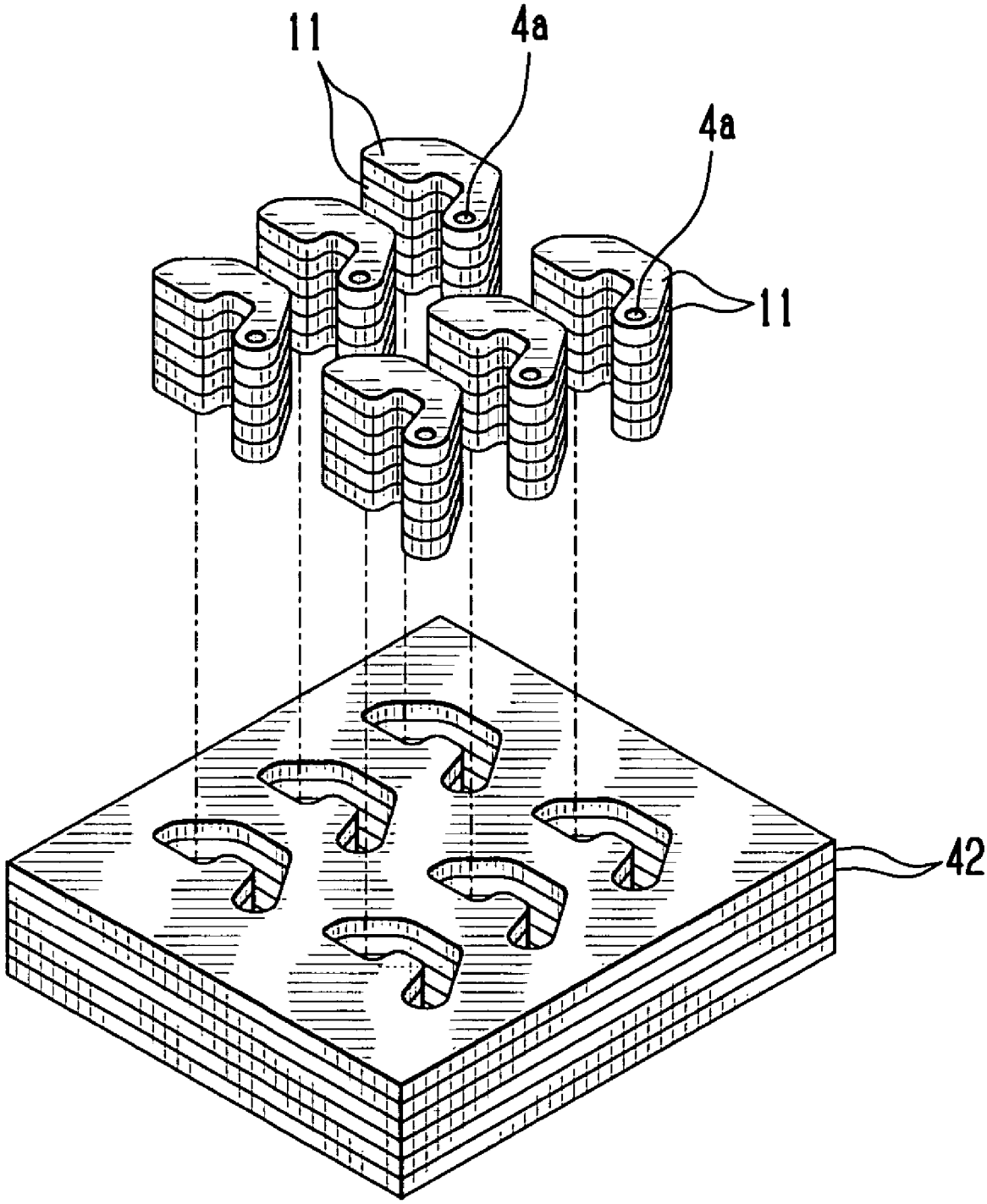
FIG. 8 illustrates a part of the third nitride layer forming process.

A forming method of forming a nitride layer T on the magnetic circuit forming member 11 of the armature 4 will now be described with reference to FIGS. 5 to 8. In the present embodiment, three types of nitride layer forming method (nitride layer forming process) will be described. Although the magnetic circuit forming member 11 (See FIG. 3) in the present embodiment is formed according to the first nitride layer forming method, this is not restrictive. For example, it may be formed according to the second and third nitride layer forming methods. FIG. 5 is a diagram illustrating the first nitride layer forming process, FIG. 6 is a diagram illustrating the second nitride layer forming process, and FIGS. 7 and 8 are diagrams illustrating the third nitride layer forming process.

In the first nitride layer forming method, as shown in FIG. 5, a magnetic circuit forming member 11 having a through hole 4*a* is stacked in two or more layers in the direction of thickness (a stacking step). In this case, two or more magnetic circuit forming members 11 are stacked with the through holes 4*a* positioned on the same straight line and with the surfaces 11*c* parallel to the direction of thickness positioned on the same plane. Pressure is applied to the two or more stacked magnetic circuit forming members 11 in the stacking direction to make the two or more stacked magnetic circuit forming members 11 adhere to each other (an adhering step). At the time, the two or more magnetic circuit forming members 11 are held in the stacking direction and pressed by a pressing member 40. For example, a screw is used as the pressing member 40, whereby the pressure is applied to two or more magnetic circuit forming members 11 by thread fastening (e.g. about 10 kgf/cm$^2$). The two or more magnetic circuit forming members 11 put in the pressed state, that is, in the adhering state, is subjected to nitriding (a nitriding step). In this case, gas soft nitriding layer treatment is used as nitriding. After that, the nitrided magnetic circuit forming member 1 is subjected to rust preventive treatment (a rust preventing step). As the rust preventive treatment, plating is performed. Thus, the generation of rust in the magnetic circuit forming member 11 is prevented.

By these steps, the nitride layer T and a deposit as the rust preventive layer are formed on the magnetic circuit forming member 11. The nitride layer T is formed on the surface of the magnetic circuit forming member 11 outside of both side surfaces 11*a*, 11*b*, that is, the inner surface of the through hole 4*a* and a surface 11*c* parallel to the penetrating direction of the through hole 4*a*. The nitride layer T is formed on the inner surface of the through hole 4*a* of the magnetic circuit forming member 11. The deposit is formed on the whole surface of the plated magnetic circuit forming member 11.

In two magnetic circuit forming members 11 positioned at both ends of the two or more magnetic circuit forming members 11, the nitride layer T is formed in the periphery of the through hole 4*a* of the side surface exposed to the outside. Although this type of magnetic circuit forming member 11 can be used in manufacturing the armature 4, it is preferable to use the member as a dummy member (a member not used as the magnetic circuit forming member 11) for the purpose of heightening the effect of restraining lowering of magnetic characteristic.

The magnetic circuit forming member 11 formed by the first nitride layer forming method has the nitride layer T on the surface outside of both side surfaces 11*a*, 11*b* which are both end faces in the penetrating direction of the through hole 4*a*. Accordingly, the nitride layer T is formed on a part requiring it, that is, the inner surface of the through hole 4*a*, so that the inner surface of the through hole 4*a* is prevented from being worn away by the fulcrum shaft 12. Further, since the nitride layer T is not formed on the whole surface of the magnetic circuit forming member 11, lowering of magnetic flux characteristic can be restrained. Thus, the stable rocking operation of the armature 4 can be realized and furthermore the magnetic characteristic required for high-speed printing can be obtained. As a result, high-speed printing is realized.

Further, according to the first nitride layer forming method, the nitride layer T can be formed on two or more magnetic circuit forming members 11 at the same time so as to improve the productivity.

In the second nitride layer forming method, as shown in FIG. 6, the magnetic circuit forming member 11 having a through hole 4*a* in the direction of thickness is held from the direction of thickness by holding members 41 not to cover the through hole 4*a* (a holding step), pressure is applied to the magnetic circuit forming member 11 held by the holding members 41 in the direction of thickness, thereby making the holding members 41 and the magnetic circuit forming member 11 adhere to each other (an adhering step). For example, as a member for applying pressure to the holding members 41, a screw is used, and the pressure is applied to the magnetic circuit forming member 11 by thread fastening. The magnetic circuit forming member 11 put in the state of being pressed, that is, adhering to the holding members 41 is subjected to nitriding (a nitriding step). In this case, gas soft nitriding layer treatment is used as nitriding. After that, the nitrided magnetic circuit forming member 11 is subjected to rust preventive treatment (a rust preventing step). As the rust preventive treatment, plating is performed. Thus, the generation of rust in the magnetic circuit forming member 11 is prevented.

By these steps, the nitride layer T and a deposit as the rust preventive layer are formed on the magnetic circuit forming member 11. The nitride layer T is formed on the surface outside of the parts coated with the holding members 41, that is, the inner surface of the through hole 4*a*, both side surfaces 11*a*, 11*b* in the periphery of the through hole 4*a* and a surface 11*c* parallel to the penetrating direction of the through hole 4*a*. The deposit is formed on the whole surface of the plated magnetic circuit forming member 11.

The magnetic circuit forming member 11 formed by the second nitride layer forming method has the nitride layer T on the surface outside of the parts coated with the holding members 41. Accordingly, the nitride layer T is formed on a part requiring it, that is, the inner surface of the through hole 4*a*, so that the inner surface of the through hole 4*a* is prevented from being worn away by the fulcrum shaft 12. Further, since the nitride layer T is not formed on the whole surface of the magnetic circuit forming member 11, lowering of magnetic flux characteristic can be restrained. Thus the stable rocking operation of the armature 4 can be realized and furthermore the magnetic characteristic required for high-speed printing can be obtained. As a result, high-speed printing is realized.

In the third nitride layer forming method, as shown in FIG. 7, a flat plate member 42 formed of magnetic material are stacked in two or more layers (a stacking step), a through hole 4*a* is formed in the stacking direction in the two or more stacked plate members 42 (a hole forming step), pressure is applied in the stacking direction to the two or more plate members 42 provided with the through hole 4*a* to make the two or more stacked plate members 42 adhere to each other (an adhering step), and the two or more plate members 42 put in the adhering state is subjected to nitriding (a nitriding step). After that, as shown in FIG. 8, a magnetic circuit forming member 11 having the through hole 4*a* is formed of the two or more nitrided plate members 42 (a member forming step). In the member forming step, with the through hole 4*a* positioned in a designated position in the magnetic circuit forming member 11, two or more magnetic circuit forming members 11 are cut out from the two or more plate members 42 (die cutting is performed). Two plate members 42 positioned at both ends of the two or more stacked plate members 42, however, are provided with the nitride layer T formed on the whole surface thereof, however, so they are used as a dummy member (a member not used as the magnetic circuit forming member 11). After that, the cut-out magnetic circuit forming member 11 is subjected to rust preventive treatment (a rust preventing step). As the rust preventive treatment, plating is performed in this case. Thus, the generation of rust in the magnetic circuit forming member 11 is prevented.

By these steps, the nitride layer T and a deposit as the rust preventive layer are formed on the magnetic circuit forming member 11. The nitride layer T is formed only on the inner surface of the through hole 4*a*. The deposit is formed on the whole surface of the plated magnetic circuit forming member 11.

The magnetic circuit forming member 11 formed by the third nitride layer forming method has the nitride layer T only on the inner surface of the through hole 4*a*. Accordingly, the nitride layer T is formed on a part requiring it, that is, the inner surface of the through hole 4*a*, so that the inner surface of the through hole 4*a* is prevented from being worn away by the fulcrum shaft 12. Further, since the nitride layer T is not formed on the whole surface of the magnetic circuit forming member 11, lowering of magnetic flux characteristic can be favorably restrained. Thus, the stable rocking operation of the armature 4 can be realized and furthermore the magnetic characteristic required for high-speed printing can be obtained. As a result, high-speed printing is realized.

Further, according to the third nitride layer forming method, the nitride layer T can be formed on two or more magnetic circuit forming members 11 (only on the inner surface of the through hole 4*a* thereof) at the same time so as to improve productivity. Although two or more magnetic circuit forming members 11 are cut out from the two or more stacked plate members 42 still in the stacking state in this case, this is not restrictive. For example, the magnetic circuit forming member 11 may be cut out in every plate member 42.

Although the nitride layer T is not formed on both side surfaces 11*a*, 11*b* of the magnetic circuit forming member 11 in the first and second nitride layer forming methods, this is not restrictive. No nitride layer T may be formed on the surface 11*c* of the magnetic circuit forming member 11 by making the member adhere to the surface 11*c* parallel to the direction of thickness of the magnetic circuit forming member 11 and performing the similar steps to those of the first and second nitride layer forming methods.

According to the present embodiment, in the step of stacking two or more magnetic circuit forming members 11, two or more magnetic circuit forming members 11 are stacked with the through holes 4*a* thereof positioned on the same straight line and with the surfaces 11*c* parallel to the direction of thickness thereof positioned on the same plane, whereby the nitride layer T can be formed on the surface outside of both side surfaces 11*a*, 11*b* of the magnetic circuit forming member 11 so as to restrain lowering of magnetic characteristic.

According to the present embodiment, since the nitride layer forming method includes the step of performing rust preventive treatment for the nitrided magnetic circuit forming member 11, plating is performed as rust preventive treatment so that the magnetic circuit forming member 11 has a deposit on the surface to prevent the generation of rust in the magnetic circuit forming member 11.

According to the present embodiment, the armature 4 includes the arm 9 supporting the wire 10 and the above magnetic circuit forming member 11 provided on the arm 9, whereby stable rocking operation of the armature 4 is realized and further magnetic characteristic required for high-speed printing can be obtained.

According to the present embodiment, the wire dot printer head 1 includes the above armature 4, the wire 10 mounted on the arm 9 of the armature 4, the yoke 6 and the armature spacer 7 as the support members supporting the armature 4 to freely rock in the direction substantially parallel to the wire 10, and the core 27 provided in the position opposite to the magnetic circuit forming member 11 of the armature 4 in the rocking direction of the armature 4, on which the coil 29 is wound, whereby stable rocking operation of the armature 4 is realized and further magnetic characteristic required for high-speed printing can be obtained.

According to the present embodiment, the wire dot printer 50 includes the above wire dot printer head 1, the platen 69 opposite to the wire dot printer head 1, the carriage 10 holding the wire dot printer head 1 and moved to reciprocate along the platen 69, and the transport roller 64 and the pressure roller 65 as the print medium transport part for transporting the print medium between the wire dot printer head 1 and the platen 69, the drive of the wire dot printer head 1, the carriage 70, the transport roller 64 and the pressure roller 65 is controlled to perform printing on the basis of print data, whereby stable rocking operation of the armature 4 is realized and further magnetic characteristic required for high-speed printing can be obtained.

Obviously, numerous modifications and variations of the present invention are possible in light of the above teachings. It is therefore to be understood that within the scope of the appended claims, the invention may be practiced otherwise than as specifically described herein.

What is claimed is:

1. A magnetic circuit forming member, comprising:
a plate-like member formed of magnetic material;
a through hole penetrating in the direction of thickness of the plate-like member; and
a nitride layer formed on the surface outside of both end faces in the penetrating direction of the through hole.

2. The magnetic circuit forming member according to claim 1, wherein a nitride layer is provided in the periphery of the through hole at one end face of both end faces.

3. A magnetic circuit forming member, comprising:
a plate-like member formed of magnetic material;
a through hole penetrating in the direction of thickness of the plate-like member; and
a nitride layer formed only on the inner surface of the through hole.

4. The magnetic circuit forming member according to claim 1, 2 or 3, wherein the member further comprises a rust preventive layer formed on the surface thereof to prevent rust on the surface.

5. An armature, comprising:
an arm supporting a print wire; and
a magnetic circuit forming member mounted on the arm, wherein the magnetic circuit forming member comprises:
a plate-like member formed of magnetic material;
a through hole penetrating in the direction of thickness of the plate-like member; and
a nitride layer formed on the surface outside of both end faces in the penetrating direction of the through hole.

6. The armature according to claim 5, wherein a nitride layer is provided in the periphery of the through hole at one end face of both end faces.

7. An armature, comprising:
an arm supporting a print wire; and
a magnetic circuit forming member mounted on the arm, wherein the magnetic circuit forming member comprises:
a plate-like member formed of magnetic material;
a through hole penetrating in the direction of thickness of the plate-like member; and
a nitride layer formed only on the inner surface of the through hole.

8. The armature according to claim 5, 6 or 7, wherein
a nitride layer is provided in the periphery of the through hole at one end face of both end faces.

9. A wire dot printer head, comprising:
an armature including an arm supporting a print wire, and a magnetic circuit forming member mounted on the arm;
a print wire mounted on the armature;
a support member supporting the armature to freely rock in the direction substantially parallel to the print wire; and
a core provided in a position opposite to the magnetic circuit forming member of the armature in the rocking direction of the armature, on which a coil is wound, wherein
the magnetic circuit forming member comprises: a plate-like member formed of magnetic material; a through hole penetrating in the direction of thickness of the plate-like member; and a nitride layer formed on the surface outside of both end faces in the penetrating direction of the through hole.

10. A wire dot printer head, comprising:

an armature including an arm supporting a print wire and a magnetic circuit forming member mounted on the arm;

a print wire mounted on the armature;

a support member supporting the armature to freely rock in the direction substantially parallel to the print wire; and a core provided in a position opposite to the magnetic circuit forming member of the armature in the rocking direction of the armature, on which a coil is wound, wherein the magnetic circuit forming member comprises:

a plate-like member formed of magnetic material;

a through hole penetrating in the direction of thickness of the plate-like member; and a nitride layer formed only on the inner surface of the through hole.

11. A wire dot printer, comprising:

the wire dot printer head as claimed in claim 9 or 10;

a platen opposite to the wire dot printer head;

a carriage holding the wire dot printer head and moved to reciprocate along the platen;

a print medium transport part for transporting a print medium between the wire dot printer head and the platen; and a unit for controlling the drive of the wire dot printer head, the carriage and the print medium transport part to perform printing on the basis of print data.

* * * * *